US007376383B2

(12) United States Patent
Segerer et al.

(10) Patent No.: US 7,376,383 B2
(45) Date of Patent: May 20, 2008

(54) DEVICE FOR REGULATION OF THE SLIDING PROPERTIES OF A PRINT SUBSTRATE IN AN ELECTROPHOTOGRAPHIC PRINTER OR COPIER

(75) Inventors: Peter Segerer, Olching (DE); Robert Lang, Allershausen (DE); Roland Wolf, Unterhaching (DE); Franz Wittmann, Isen (DE); Said Youzbachi, Munich (DE); Hans-Georg Coufal, Markt Schwaben (DE); Günther Eder, Munich (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 11/734,094

(22) Filed: Apr. 11, 2007

(65) Prior Publication Data

US 2007/0177917 A1 Aug. 2, 2007

Related U.S. Application Data

(62) Division of application No. 11/006,853, filed on Dec. 8, 2004, now Pat. No. 7,248,828.

(30) Foreign Application Priority Data

Jan. 15, 2004 (DE) ..... 10 2004 002 234

(51) Int. Cl.
*G03G 15/00* (2006.01)

(52) U.S. Cl. ..... 399/407; 399/341; 399/390; 399/392; 399/406

(58) Field of Classification Search ..... 399/341, 399/390, 392, 407, 406
See application file for complete search history.

(56) References Cited

U.S. PATENT DOCUMENTS

| | | | | |
|---|---|---|---|---|
| 4,567,673 | A | 2/1986 | Bohnensieker | |
| 5,043,318 | A | 8/1991 | Kawakami et al. | |
| 5,264,899 | A | 11/1993 | Mandel | |
| 5,805,969 | A | 9/1998 | Elsermans et al. | |
| 5,895,154 | A | 4/1999 | Acquaviva et al. | |
| 6,249,667 | B1 | 6/2001 | Acquaviva et al. | |
| 6,259,887 | B1 | 7/2001 | Awano | |
| 6,318,263 | B1 | 11/2001 | De Vroome | |
| 6,435,094 | B1 | 8/2002 | Siler et al. | |
| 2003/0031484 | A1 * | 2/2003 | Mills | 399/341 |

FOREIGN PATENT DOCUMENTS

| | | |
|---|---|---|
| DE | 41 36 878 | 7/1995 |
| WO | WO 01/98840 | 12/2001 |

* cited by examiner

*Primary Examiner*—David M Gray
*Assistant Examiner*—Ryan D. Walsh
(74) *Attorney, Agent, or Firm*—Schiff Hardin LLP

(57) ABSTRACT

In an electrophotographic printer or copier, toner images of images to be printed onto a printing substrate are generated and fixed, causing sliding characteristics to be worsened. In order to remedy this problem, a moistening device is provided that applies on the printing substrate a moistening agent made from a moistening fluid and a lubricant dissolved therein. Two problems are thus solved: the printing substrate is moistened and simultaneously lubricated.

18 Claims, 3 Drawing Sheets

DEVICE FOR REGULATION OF THE SLIDING PROPERTIES OF A PRINT SUBSTRATE IN AN ELECTROPHOTOGRAPHIC PRINTER OR COPIER

RELATED APPLICATION

This is a divisional application of Ser. No. 11/006,863 filed Dec. 8, 2004 now U.S. Pat. No. 7,248,828 of the same inventors entitled "DEVICE FOR REGULATION OF THE SLIDING PROPERTIES OF A PRINT SUBSTRATE IN AN ELECTROPHOTOGRAPHIC PRINTER OR COPIER"

BACKGROUND

In print media production, after a printing or copying device a more or less elaborate post-processing is often implemented for a printing substrate, for example a paper web or paper sheets. The finished printer products are thereby produced from the printing substrate formats used for the printing. Machines of the post-processing can be, for example, cutters, binders, folders, and staplers.

In electrophotographic printing, the toner images (generated on the printing device in the printing device) of the images to be printer are fixed and therewith connected with the printing substrate. This method is known (see WO 01/98840 A2, which is herewith incorporated into the disclosure) and is therefore not explained further here The fixing can occur in various ways, for example via roller fixing under pressure and heat or via radiation fixing. For the individual techniques, reference is made to the already-cited WO 01/98840 A2. In the fixing, the printing substrate is thus exposed to heat or pressure, with the consequence that its dampness and sliding properties are negatively influenced. In particular, however, poor sliding properties of the printing substrate can lead to the fixed toner layer being mechanically damaged or smeared in the machines of the post-processing. These damages can lead to accumulations of toner particles at exposed machine parts, which can in turn lead to unwanted toner deposits on the printing substrate. From WO 01/98840 A2 it is known to improve the post-processing of the printing substrate in that the printing substrate is moistened, such that the loss of dampness caused by the printing is compensated for. Water is normally used as a means for moistening.

In general, however, for an acceptable print quality, contamination, particularly on the printing substrate, must be prevented at the machines, in particular for the post-processing. However, it is not sufficient to moisten the printing substrate corresponding to WO 01/98840 A2. Rather, its sliding properties must also be improved.

SUMMARY

An object is to achieve an improvement of the sliding properties of an at least partially printed printing substrate without a greater effort being necessary.

In a device or method for regulation of sliding properties of a printing substrate in an electrophotographic printer or copier that generates and fixes toner images of images to be printed onto the printing substrate, a moistening device is provided that applies on the printing substrate a moistening agent made from a moistening fluid and a lubricant dissolved therein

DESCRIPTION OF THE PREFERRED EMBODIMENTS

Figure 1:
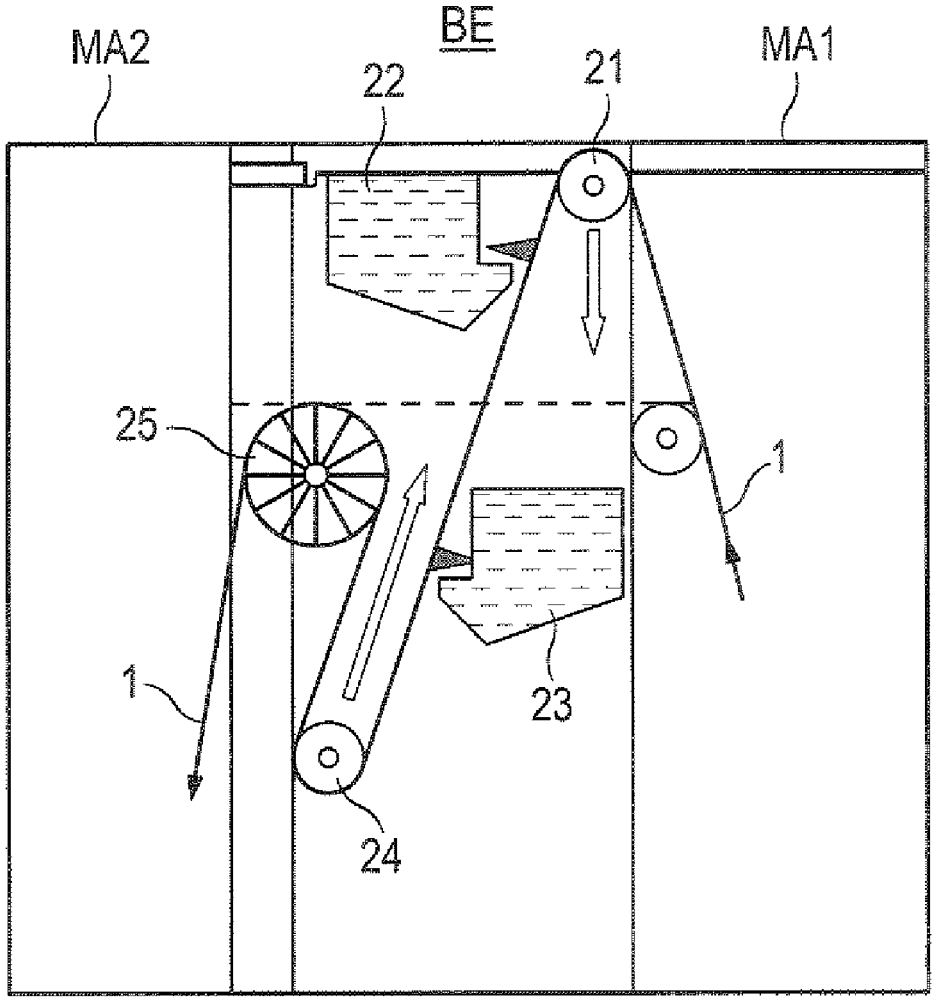
FIG. 1 is a principal representation of a first moistening device.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

An improvement of the sliding properties of the printing substrate is achieved with a moistening device that can be used to supplement the dampness of the printing substrate. For this, only a different moistening agent, comprised of the moistening fluid and the lubricant dissolved therein, has to be added to the moistening device.

All agents that, applied to the printing substrate, lead to an improvement of the sliding properties of the printing substrate can be used as a lubricant. Advantageous lubricants are, for example, silicon oil and lubricants based on silicon oil. For example, wax or a polymer can be added to the silicon oil as additives, and from this an emulsion can be formed. Furthermore, the use as lubricants of means used for cooling in drills for metal processing is possible. These can be based on a mineral, vegetable or synthetic base.

The proportion of lubricant in the moistening agent depends on the type of the printing substrate. For each printing substrate, a special moistening agent can be provided. The proportion of lubricant can thereby be measured, for example via determination of the electrical conductivity of the moistening agent that depends on the proportion of the lubricant in the moistening agent. With this measurement result, the correct moistening agent can be adjusted per printing substrate.

Upon changing a printing substrate in the printing device, a different moistening agent must normally also be used. In order to already have no problems with an incorrectly adjusted moistening agent at the beginning of the print, it is appropriate to remove the previous moistening agent from the moistening device before the new moistening agent is poured into the moistening device. It is advantageous when the device is designed such that the cleaning of the moistening device is automated.

The moistening device can be arranged in the machines of the post-processing of the printed printing substrate, and thus outside of the electrophotographic printer or copier device. However, it is also possible to arrange the moistening device in the printer or copier device appropriately behind the station that implements the fixing of the toner images on the printing substrate.

The moistening device can comprise one or more rotor nebulizers (atomizers) or spray nozzles.

In a second embodiment, the moistening device can comprise a roller arrangement with at least one application roller for the moistening systems means that is arranged on one side of the printing substrate such that it can print on the printing substrate, with an application element, associated with the application roller, that can be pivoted onto the application roller and transfers the moistening agent onto the application roller, and with a counter-element on the side of the printing substrate lying opposite the application roller.

The counter-element can be a further application roller with an associated further application element, such that the printing substrate can be moistened on both sides.

It is appropriate when the application roller is freely movable and is entrained or taken along by the printing substrate. An additional actuator drive is then unnecessary.

It is advantageous when the pivoting device of the application roller for the printing substrate and the pivoting device of the application element for the application roller lie approximately perpendicular to one another. The movements of application roller and application element are then decoupled from one another and can be separately adjusted.

To generate the pivot movement of the application roller, this can be borne on a first linkage lever that, for its part, is positioned in a housing. A first pressure element that exerts a force on the first linkage lever, and therewith on the application roller in the direction towards the printing substrate, can be arranged between the housing and the first linkage lever. Furthermore, the application element can be borne on a second linkage lever that is, for its part, positioned on the housing. A second pressure element that exerts a force on the second linkage lever, and therewith on the application element in the direction towards the application roller, can be arranged between the housing and the second linkage lever.

The force of the pressure elements can be individually adjusted. This can occur via a spring.

In order to be able to moisten the entire printing substrate, it is appropriate to adapt (in terms of their width) the respective application roller and the respective application element to the width of the printing substrate, and to arrange the application roller and the application element at both ends in linkage levers on which the pressure elements engage.

The application element can comprise a feedthrough and a distributor channel with a distributor gap towards the application roller. When the distributor gap is narrowed in comparison with the distributor channel, the moistening agent can be evenly applied on the application roller.

When a conveyor system that supplies the moistening agent to the application element is connected at the feedthrough, it is appropriate to arrange the conveyor system below the application element. Given operation pauses, it is thereby prevented that the moistening agent arrives at the application roller.

FIG. 1 shows a first embodiment of the moistening device BE in principle representation. The device BE can be arranged at the output of a printing device MA1 or be integrated there. The printing substrate web 1 can be fed to a post-processing machine MA2.

A printing substrate 1, for example a paper web, is moved via a deflection roller 21 into the moistening device BE. In the exemplary embodiment, two moistening modules 22 and 23, respectively one on each side of the printing substrate 1, are arranged in the moistening device BE. Each side of the printing substrate 1 can therewith be charged with a moistening system. However, it is also possible to provide only one moistening module on one side of the printing substrate 1. Furthermore, a further deflection roller 24 is arranged such that the printing substrate 1 stretched on the moistening modules 22, 23 can be moved past. Finally, a deflection roller 25 via which the printing substrate 1 can be fed to a post-processing machine MA2 can be arranged at the output of the moistening device BE. The deflection rollers 21, 24 can be shifted in a direction relative to one another.

The moistening modules 22, 23 can be built in a known manner. They can, for example, be realized as a rotor nebulizer (atomizer) as they are disclosed in DE 41 36 878 C2, or as spray nozzles. With such a rotor nebulizer, the moistening agent can be sprayed on the printing substrate 1. Since the moistening agent comprises both a moistening fluid and a lubricant, the printing substrate 1 is both moistened in order to compensate for the dampness loss and the sliding capability is increased in order to make the printing substrate 1 more slippery again. The losses of dampness and sliding capability caused by the printing can thus be remedied again, and independent of this additionally the sliding capability is advantageously influenced. The printing substrate 1 can subsequently be further processed again without the unwanted deposits (described above) of toner being able to occur on the post-processing machines or at stations in the printing device. A worsening of the print quality is thereby in any case prevented.

In order to achieve both described advantages, the moistening system is composed of two components: a moistening fluid, for example water, and a lubricant. The lubricant must thus be soluble in the moistening fluid. Examples for such lubricants are: silicon oil; silicon oil with additives such as wax or a polymer; mineral, vegetable or synthetic oils as they are used for cooling of drills.

Since the printing substrates 1 can exhibit different properties with regard to dampness and sliding capability, it is appropriate to provide different moistening agents corresponding to the printing substrates to be printed. For this it is necessary to adapt the proportion of lubricant in the moistening agent to the printing substrate. An example of a proportion of lubricant in relation to the moistening fluid can be 1 to 10.

The proportion of the lubricant in the moistening agent can, for example, be determined via the electrical conductivity of the moistening agent, which depends on the proportion of the lubricant. The moistening agent associated with a printing substrate can naturally also be empirically determined.

Figure 2:
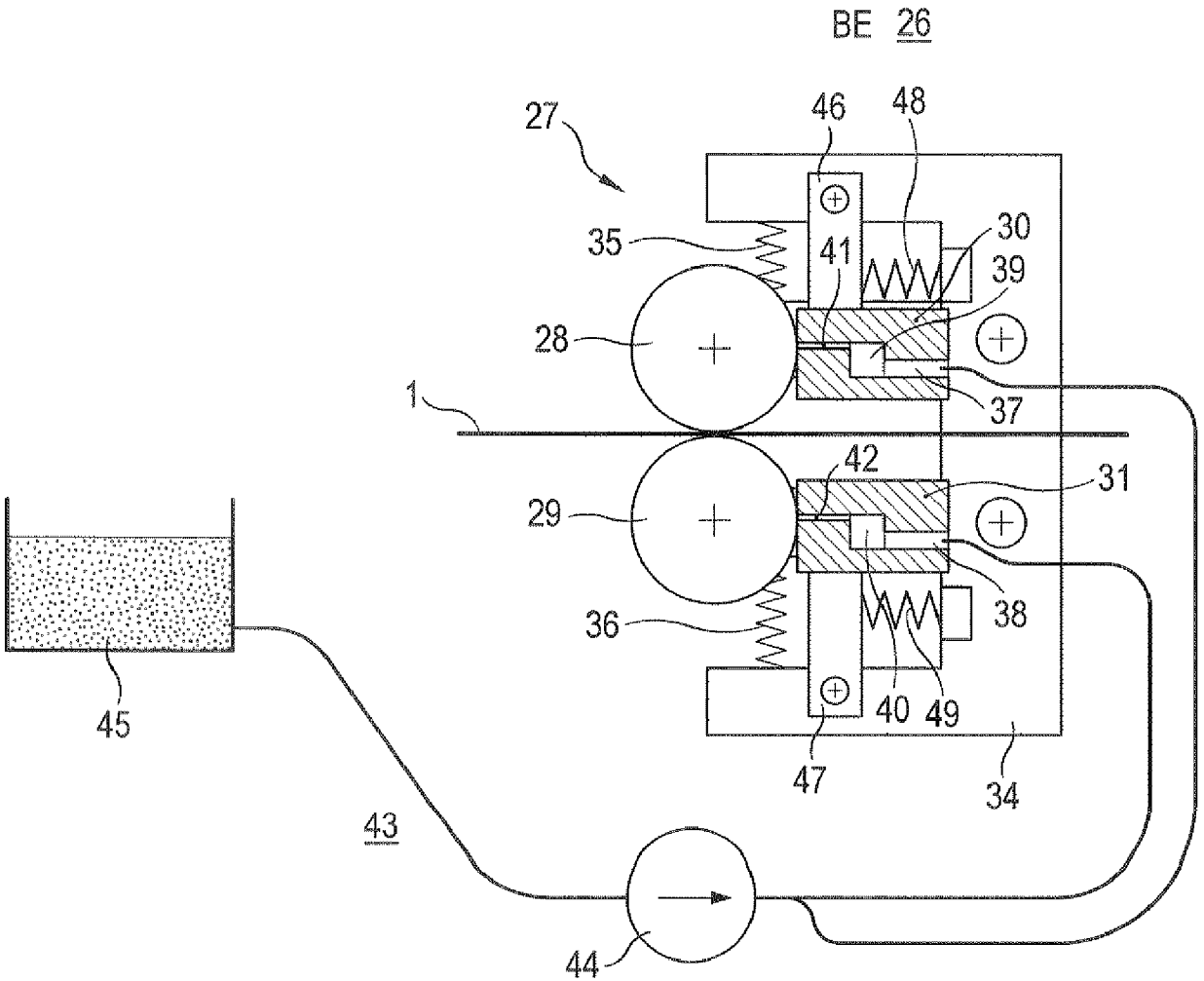
FIG. 2 is a representation of a second moistening device with a roller arrangement in front view.
Figure 3:
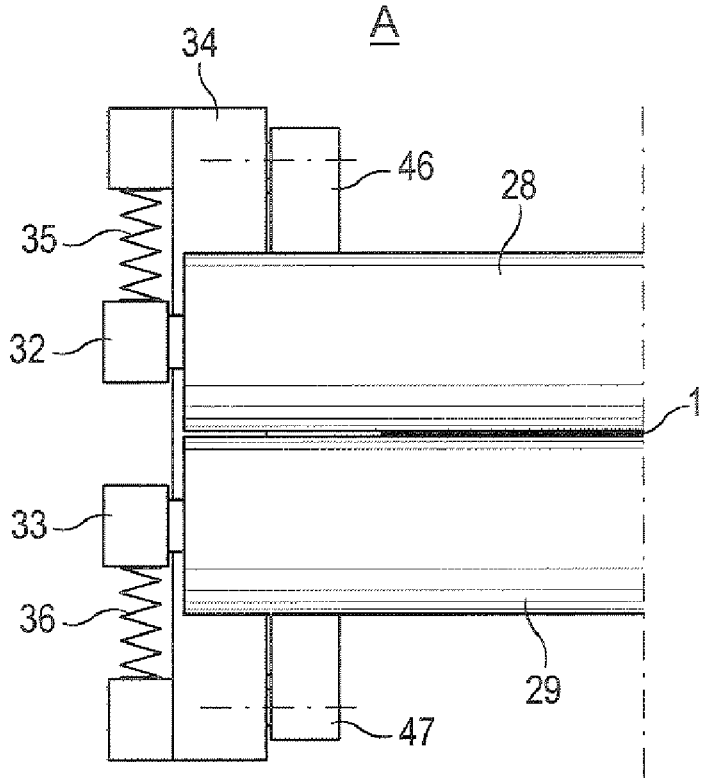
FIG. 3 shows the moistening device according to FIG. 2 in side view (perspective A)
Figure 4:
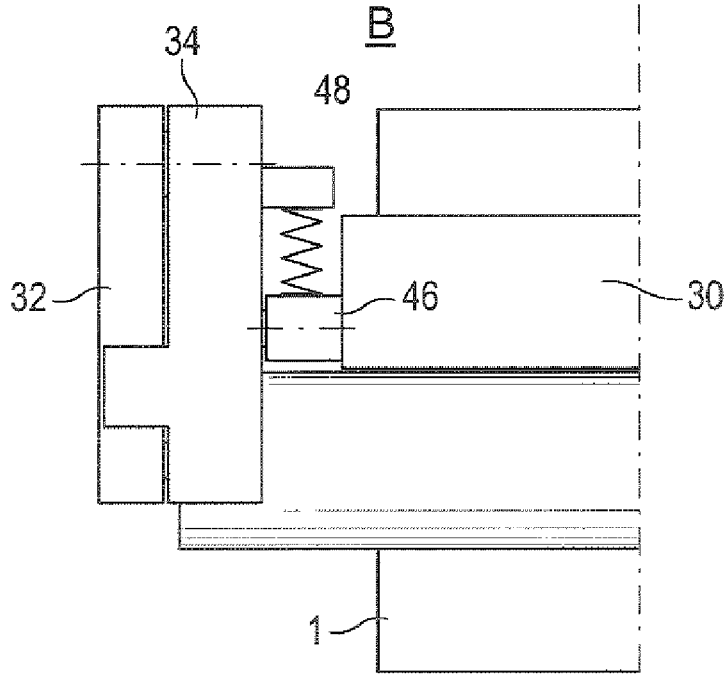
FIG. 4 is a view from above (perspective B), respectively in half-representation.

FIGS. 2 through 4 show a further moistening device BE, 26 that is realized as a roller arrangement 27. In the exemplary embodiment, application rollers 28, 29 for supply of the moistening agent are arranged on both sides of the printing substrate 1, which application rollers can, however, be identically designed and which are dealt with together in the following.

The moistening device 26 thus comprises application rollers 28 or 29 and application elements 30 or 31 in order to be able to moisten the printing substrate 1 on both sides. When the printing substrate 1 should only be moistened on one side, one application roller is sufficient. It is then appropriate to arrange a counter-element, for example a rod, on the other side of the printing substrate 1, against which the application roller presses the printing substrate 1.

The application rollers 28 or 29 are borne on a first linkage lever 32 or 33 that, for its part, are positioned in a housing 34. A force acts on the linkage lever 32 or 33 in the direction towards the printing substrate 1. This force can be realized with the aid of a spring 35, as shown in FIGS. 2 through 4. However, it is also possible to realize the force with a hydraulic, pneumatic force element or via a weight. It is therewith ensured that the application rollers 28 or 29 bear on the printing substrate 1.

The moistening of the application rollers 28 or 29 with the moistening agent occurs with the aid of the application elements 30 or 31, which comprise a feedthrough, 37 or 38 and a distributor channel 39 or 40 with a distributor gap 41 or 42. The moistening agent is supplied to the application element 30 or 31 via a conveying system 43 that, for example, can comprise a pump 44 and a reservoir 45. The moistening agent is supplied by the conveying system 43 to the feedthrough 37 or 38 and arrives from there into the distributor channel 39 or 40 and the distributor gap 41 or 42. Given small application quantities, the dosing occurs via the capillary effect of the distributor gap 41 or 42. The distributor gap 41 or, respectively, 42 can also be equipped with a permeable material (such as, for example, a fleece, wick, sintered material) to improve the capillary effect. Given larger application quantities of moistening agent, the pressure of the conveying system 43 can be adjusted such that a specific fluid quantity is set based on the flow resistance of the distributor gap 41 or 42. It is thus important that the flow resistance of the distributor gap 41 or 42 is clearly larger than the other flow resistances in the feed for the moistening agent. When the pump 44 and the reservoir 45 are arranged below the application elements 30 or 31, this has the advantage that the moistening agent flow ceases as soon as the pump 44 stops. A drip of moistening agent onto the printing substrate 1 is thus prevented.

In order to ensure the transfer of moistening agent onto the application rollers 28 or 29, it is appropriate to bear the application element 30 or 31 on a second linkage lever 46 or 47 that, for its part, is positioned in the housing 34. The suspension of application roller 28 or 29 and application element 30 or 31 can thus be such that the movement direction of the application roller 28 or 29 relative to the printing substrate 1 and the movement direction of the application element 30 or 31 relative to the application roller 28 or 29 are approximately perpendicular to one another. The contact pressure of the application roller 28 or 29 on the printing substrate 1 and of the application element 30 or 31 on the application roller 28 or 29 is then decoupled and independently adjustable. In order to ensure a reliable transfer of the moistening agent onto the application roller 28 or 29, a force can engage at the second linkage lever 46 or 47 in the direction of the application roller 28 or, respectively, 29. This force can be realized via a spring 48 or 49 or another force element.

Via the force elements that engage on the application rollers 28 or 29, with an uneven preliminary tension a uniform pressure can be exerted on the printing substrate 1 when the printing substrate 1 is asymmetrically guided. The second moistening device 26 can naturally also only be used for lubrication of the printing substrate 1 in order to improve its sliding characteristics. Only the lubricant is then supplied to it.

The moistening device BE can be used both for processing of sheet-shaped and web-shaped printing substrates. Its use is not only reasonable in order to make up for losses of dampness or sliding capability caused by the fixing; it can also be used in While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

We claim as our invention:

1. A moistening device for regulation of sliding properties of a printing substrate in an electrophotographic printer or copier that generates and fixes toner images of images to be printed onto the printing substrate, comprising:

a rotor nebulizer or a spray nozzle arranged adjacent to the printing substrate that applies on the printing substrate in a single process both a moistening agent made from a moistening fluid and a lubricant soluble therein to simultaneously both regulate the sliding properties and moisten the printing substrate.

2. A moistening device according to claim 1 in which the moistening fluid comprises water.

3. A moistening device according to claim 1 in which the moistening device is executed such that, upon change of the printing substrate, the moistening agent previously present in the moistening device is removed and a moistening agent associated with the new printing substrate is poured in.

4. A moistening device according to claim 1 in which two rotor nebulizers or spray nozzles are provided, one at one side of the printing substrate and another at an opposite side.

5. A Moistening device for regulation of sliding properties of a printing substrate in an electrophotographic printer or copier that generates and fixes toner images of images to be printed onto the printing substrate, comprising:

a rotor nebulizer or a spray nozzle arranged adjacent to the printing substrate that applies on a printing substrate a moistening agent made from a moistening fluid and a lubricant soluble therein; and the lubricant comprising silicon oil.

6. A moistening device according to claim 3 in which the lubricant comprises an emulsion based on a silicon oil.

7. A moistening device according to claim 6 in which an additive is mixed with the silicon oil.

8. A moistening device according to claim 7 in which the additive comprises at least one of wax and a polymer.

9. A Moistening device for regulation of sliding properties of a printing substrate in an electrophotographic printer or copier that generates and fixes toner images of images to be printed onto the printing substrate, comprising:

a rotor nebulizer or a spray nozzle arranged adjacent to the printing substrate that applies on a printing substrate a moistening agent made from a moistening fluid and a lubricant soluble therein; and the lubricant comprising an emulsion based on at least one of a mineral, vegetable or synthetic oil.

10. A moistening device according to claim 9 in which the emulsion comprises a cooling lubricant usable in metal processing.

11. A Moistening device for regulation of sliding properties of a printing substrate in an electrophotographic printer or copier that generates and fixes toner images of images to be printed onto the printing substrate, comprising:

a rotor nebulizer or a spray nozzle arranged adjacent to the printing substrate that applies on a printing substrate a moistening agent made from a moistening fluid and a lubricant soluble therein; and a proportion of the lubricant in the moistening agent is dependent on the printing substrate to be printed.

12. A moistening device according to claim 11 in which the proportion of the lubricant in the moistening agent is determined via measurement of its electrical conductivity, and lubricant is added to the moistening agent dependent on the measurement.

13. An electrophotographic printer or copier device, comprising:

a printing station; and at least one post-processing device after the printing station at an output of the printer or copier device which processes the printing substrate, the at least one post-processing device comprising a rotor nebulizer or a spray nozzle arranged adjacent to the printing substrate that applies on the printing substrate in a single process a moistening agent made from a moistening fluid and a lubricant soluble therein to simultaneously both regulate sliding properties and moisten the printing substrate.

14. An electrophotographic printer or copier device according to claim 13 in which the moistening device is arranged after a post-processing device that last negatively influences at least one of a dampness and a sliding characteristic of the printing substrate.

15. An electrophotographic printer or copier device according to claim 13 in which the moistening device is arranged within the printer or copier device after a station for fixing of the toner images onto the printing substrate.

16. A method for moistening and lubricating a printing substrate in an electrophotographic printer or copier device wherein a moistening agent made from a moistening fluid and a lubricant soluble therein is applied in a single process on the printing substrate with a moistening device comprising a rotor nebulizer or a spray nozzle arranged adjacent to the printing substrate to simultaneously both regulate sliding properties and moisten the printing substrate.

17. An electrophotographic printer or copier device, comprising:

a printing device that generates toner images of images to be printed onto the printing substrate;

a fixing device which fixes the toner images on the printing substrate, said fixing device deteriorating moisture content and sliding properties of the printing substrate; and a moistening device comprising a rotor nebulizer or a spray nozzle arranged adjacent to the printing substrate that applies on the printing substrate in a single process a moistening agent comprising a moistening fluid and a lubricant soluble therein to simultaneously both improve moisture content and slidability of the printing substrate.

18. A method for regulation of sliding properties of a printing substrate in an electrographic printer or copier that generates and fixes toner images onto the printing substrate, and wherein the fixing deteriorates moisture content and sliding properties of the printing substrate, comprising the steps of:

providing a moistening device comprising a rotor nebulizer or a spray nozzle arranged adjacent to the printing substrate, the moistening device being located after a fixing station; and with the moistening device applying on the printing substrate in a single process a moistening agent comprising a moistening fluid and a lubricant soluble therein to simultaneously both regulate the sliding properties and moisten the printing substrate.

* * * * *